US006976894B1

(12) United States Patent
Turner

(10) Patent No.: US 6,976,894 B1
(45) Date of Patent: Dec. 20, 2005

(54) COMBINATION WET SUIT AND FLOTATION DEVICE

(76) Inventor: Franklin A. Turner, 2381 Mossybank Dr., #7, Sacramento, CA (US) 95833

( * ) Notice: Subject to any disclaimer, the term of this patent is extended or adjusted under 35 U.S.C. 154(b) by 0 days.

(21) Appl. No.: 10/948,647

(22) Filed: Sep. 24, 2004

(51) Int. Cl.[7] ..... B63C 9/08
(52) U.S. Cl. ..... 441/102; 405/186
(58) Field of Search ..... 441/102, 103, 441/104, 107, 92; 405/186

(56) References Cited

U.S. PATENT DOCUMENTS 576,649 A * 2/1897 Bell et al. ..... 441/102
2,306,488 A 12/1942 Morner
D199,514 S 11/1964 O'Neill
4,242,769 A * 1/1981 Rayfield et al. ..... 441/91
4,397,636 A 8/1983 Ganshaw
4,673,366 A * 6/1987 Hawkins ..... 441/90
4,704,092 A 11/1987 Liukko
5,022,878 A 6/1991 Casad
D359,097 S 6/1995 Crandall et al.
5,759,076 A 6/1998 Bateman et al.
6,666,622 B1 * 12/2003 Courtney et al. ..... 405/186

* cited by examiner

*Primary Examiner*—Jesus D. Sotelo

(57) ABSTRACT

The present invention advantageously provides a combination wet suit and flotation device integral with the wet suit so that a user can maintain unrestricted movement during water-sport activities, which improves convenience and comfort. A wet suit worn by water-sport a participant includes a torso section having a pocket provided with a movable flap and a waterproof seal. A $CO_2$ canister is housing with the pocket and includes a strap positioned thereabout for securing the canister during operating conditions. A pull cord is connected to the canister and associated valve for actuating the flow of $CO_2$ into a bladder defined adjacent the torso section of the wet suit. In operation, when a user pulls the cord, the canister inflates the bladder for assisting to maintain a user's head above the water line.

12 Claims, 5 Drawing Sheets

COMBINATION WET SUIT AND FLOTATION DEVICE

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to a wet suit and, more particularly, to a combination wet suit and flotation device including an actuator for inflating a bladder integral with the wet suit so that a user's head can be maintained above a water line during emergency conditions.

2. Prior Art

There are many different types of personal flotation devices currently in use by water sport enthusiasts. In particular, a personal flotation device such as a Coast Guard Type III life vest is popular. These life vests are designed for use in calm inland waters where there is a good chance of fast rescue. These vests, however, are not suitable to be worn by individuals that are performing activities such as diving or surfing which requires constant and free range of movement, and thus leaves them in a dangerous situation when staying above water becomes a problem. As such, the performance along with the comfort and wearability of the personal flotation device is important.

In addition, the wearability of the personal flotation device is affected by the buoyancy of the personal flotation device. Typically, the buoyant material of the personal flotation device is distributed along the front and back of the wearer for ease of wear and movement. However, the maximum buoyancy of the device which can be achieved is often reduced by the manufacturer in order to achieve a lighter weight and less bulky personal flotation device. This could be overcome by using a substance, such as a gas, which can be stored in a compressed manner and then be expanded only when necessary.

Accordingly, a need remains for a combination wet suit and flotation device for maintaining a user's head above a water line that is easy to wear, convenient, and improves a water-sport enthusiast's safety.

BRIEF SUMMARY OF THE INVENTION

In view of the foregoing background, it is therefore an object of the present invention to provide a combination wet suit and flotation device. These and other objects, features, and advantages of the invention are provided by a combination wet suit and personal flotation device for maintaining a user's head above a water line. The wet suit is adaptable for conforming to a user's body and is formed from waterproof material for obvious reasons.

For example, the wet suit may be formed from flexible neoprene material for advantageously maintaining a user's body temperature at a safe level. Such a wet suit includes an upper torso section that has front and rear portions wherein the rear portion includes a pocket that has a flap movable between open and closed positions for maintaining a waterproof seal. Such a pocket includes a flexible retaining strap that has opposed end portions secured within the pocket and removably fastened thereto respectively. The strap advantageously secures objects thereto and assists a user to maintain the objects in a substantially stable and dry position. The wet suit further has a pair of leg and arm portions integral with the torso section and extending outwardly therefrom.

The wet suit further includes a water proof clip that has removably engageable first and second portions attached to the flap and the pocket respectively. The first portion is disengaged from the second portion when the second portion is pushed forwardly away from the flap portion so that a user can effectively access the pocket and advantageously replace a $CO_2$ canister (described hereinbelow) during periodic intervals.

The device also includes an inflatable bladder integral with the front portion of the torso section and positioned generally medially thereof subjacent to the user's head. Such a bladder defines a cavity for receiving decompressed $CO_2$ therein and thereby providing buoyancy as needed.

The present invention further includes a mechanism for inflating the bladder. The inflating mechanism preferably includes a $CO_2$ canister disposed within the pocket for dispensing $CO_2$ during operating conditions. The strap extends about a partial circumference of the canister for effectively maintaining same at a substantially stable position. The inflating mechanism further includes a valve for regulating the flow of $CO_2$ into the bladder and a tube that has a horizontally disposed longitudinal axis and opposed end portions for defining a pathway through which $CO_2$ is directed. One such end portion is connected to the canister and another such end portion is connected to the valve.

The inflating mechanism also includes a flexible pull cord including a handle for initiating the flow of $CO_2$. The pull cord has opposed end portions secured to the valve and the handle respectively. The handle assists a user to selectively pull the cord and open the valve for advantageously inflating the bladder wherein the bladder is caused to expand as $CO_2$ flows out of the canister and into the bladder.

The present invention also includes a mechanism for conveniently adapting the wet suit between open and closed positions. Such an adapting mechanism, preferably including a zipper, is secured along the torso section. Of course, other conventional fasteners such as Velcro, for example, may be employed without departing from the true scope of the present invention.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
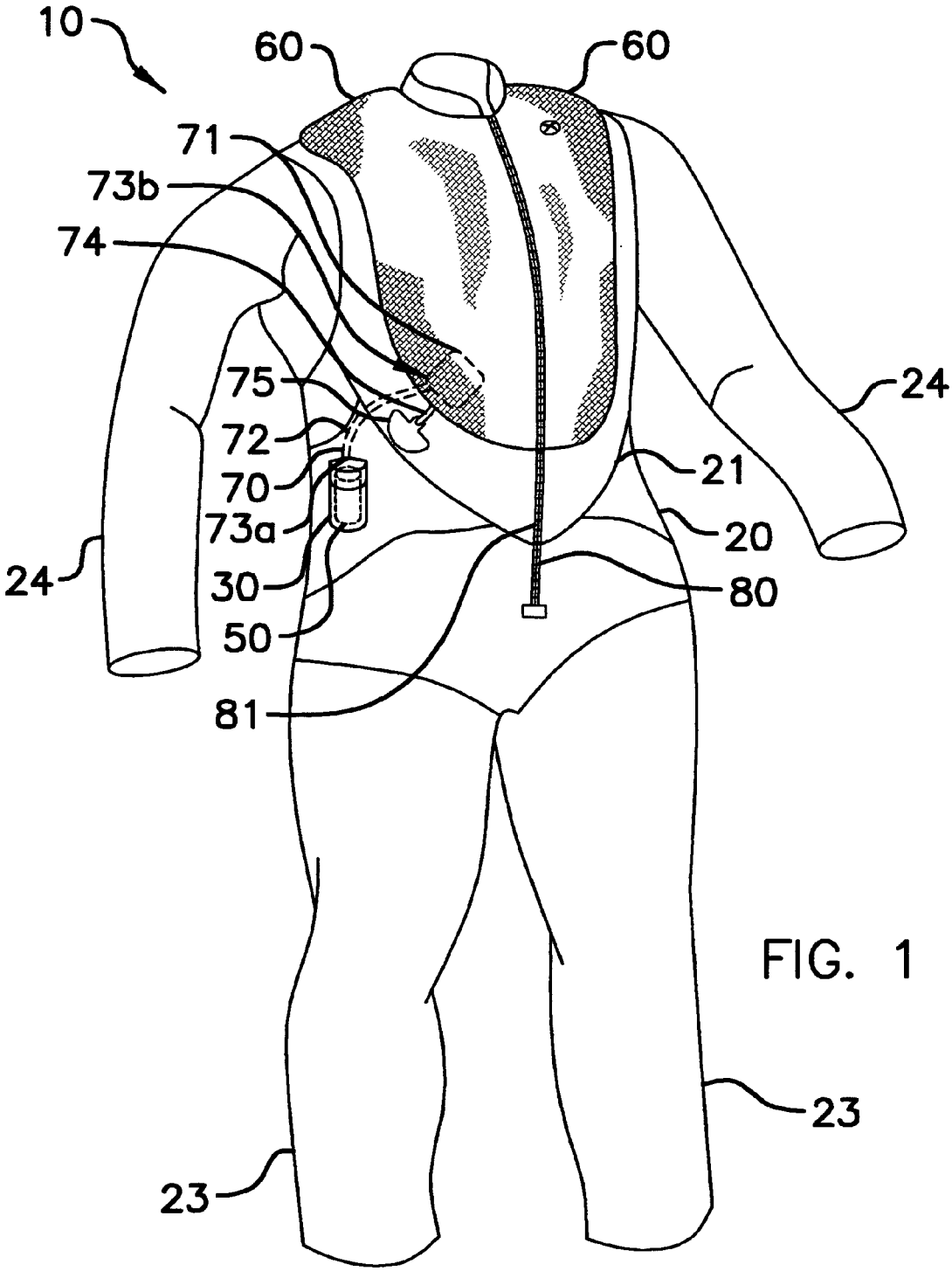
FIG. 1 is a perspective view showing a combination wet suit flotation device, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The device of this invention is referred to generally in FIGS. 1–7 by the reference numeral 10 and is intended to provide a combination wet suit and flotation device. It should be understood that the device 10 may be used to inflate many different objects and should not be limited to only wet suits.

Figure 4:
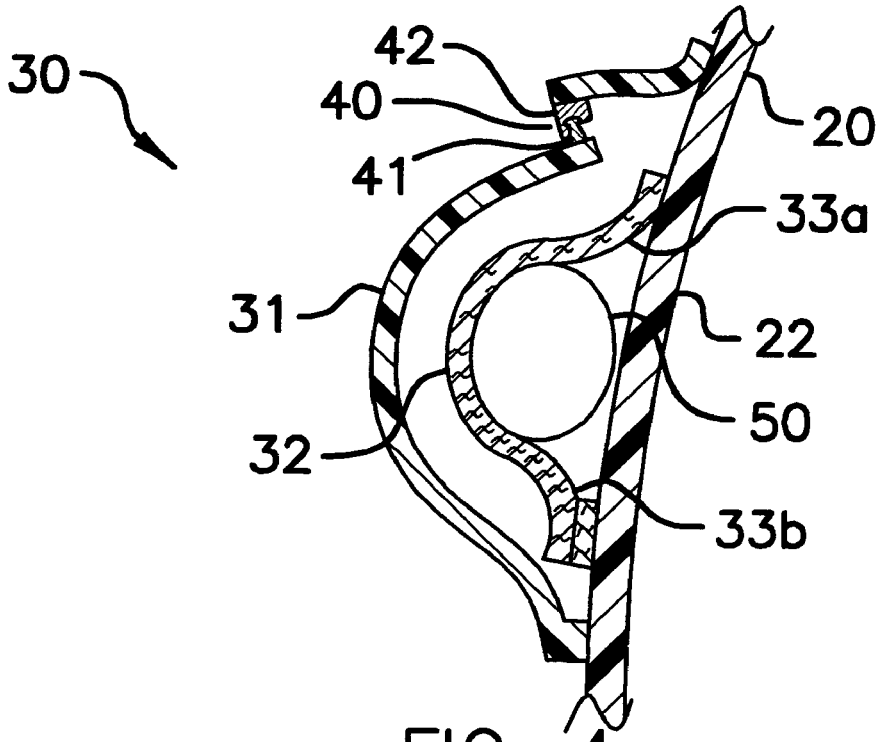
FIG. 4 is an enlarged cross-sectional view of the pocket and adjustable strap, taken along line 4—4 in FIG. 3.
Figure 5:
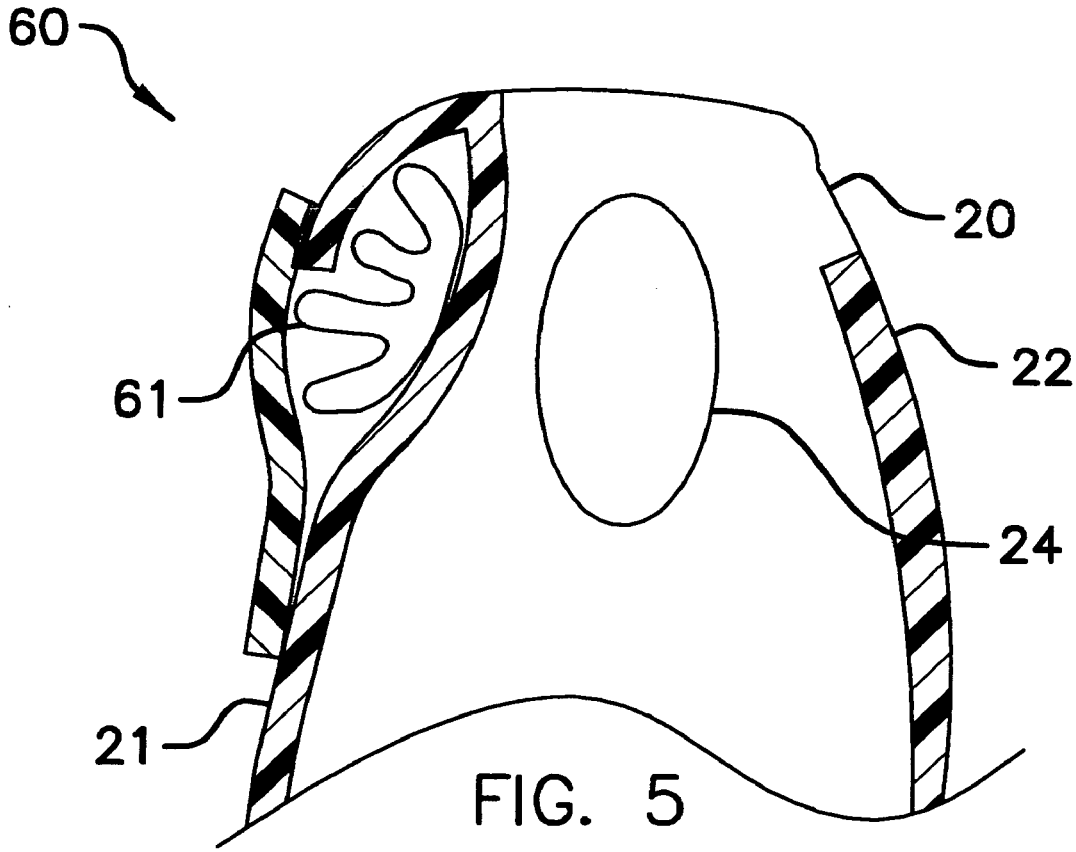
FIG. 5 is an enlarged cross-sectional view showing the bladder at a deflated position.

Referring initially to FIG. 1, the device 10 includes an upper torso section 20 that has front 21 and rear 22 portions wherein the rear portion 22 includes a pocket 30 that has a flap 31 movable between open and closed positions for maintaining a water-proof seal. As can be seen in FIG. 4, such a pocket 30 includes a flexible retaining strap 32 that has opposed end portions 33*a*, b secured within the pocket 30 and removably fastened thereto respectively. The strap 32 advantageously secures objects thereto and assists a user to maintain the objects in a substantially stable and dry position. The wet suit 10 further has a pair of leg 23 and arm 24 portions integral with the torso section 20 and extending outwardly therefrom.

The wet suit 10 further includes a water proof clip 40, as illustrated in FIG. 4, which has removably engageable first 41 and second 42 portions attached to the flap 31 and the pocket 30 respectively. The first portion 41 is disengaged from the second portion 42 when the second portion 42 is pushed forwardly away from the flap portion 31 so that a user can effectively access the pocket 30 and advantageously replace a $CO_2$ canister 50 (described hereinbelow) during periodic intervals. The water proof clip 40 prevents water from entering the canister 50, which under normal circumstances would damage the canister 50, respectively.

The device 10 also includes an inflatable bladder 60 integral with the front portion 21 of the torso section 20 and positioned generally medially thereof subjacent to the user's head. The positioning of the bladder 60 ensures that it will keep an individual afloat when inflated, but also advantageously does not restrict the movement of the wet suit 10 wearer when it is deflated. Such a bladder 60 defines a cavity 61 for receiving decompressed $CO_2$ therein and thereby providing buoyancy as needed.

Figure 7:
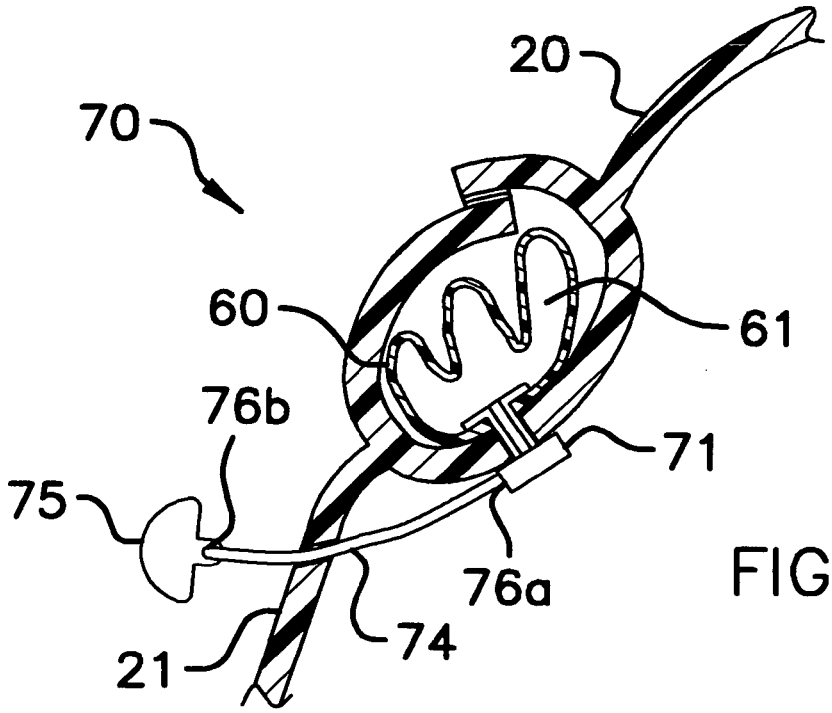
FIG. 7 is a cross-sectional view of the bladder showing the pull-cord and valve attached thereto.

The present invention further includes a mechanism 70 for inflating the bladder 60. The inflating mechanism 70 includes a $CO_2$ canister 50 disposed within the pocket 30 for dispensing $CO_2$ during operating conditions. The strap 32 extends about a partial circumference of the canister 50 for effectively maintaining same at a substantially stable position. As is shown in FIG. 7, the inflating mechanism 70 further includes a valve 71 for regulating the flow of $CO_2$ into the bladder 60 and a tube 72 that has a horizontally disposed longitudinal axis and opposed end portions 73 for defining a pathway through which $CO_2$ is directed. One such end portion 73*a* is connected to the canister 50 and another such end portion 73*b* is connected to the valve 71.

Figure 2:
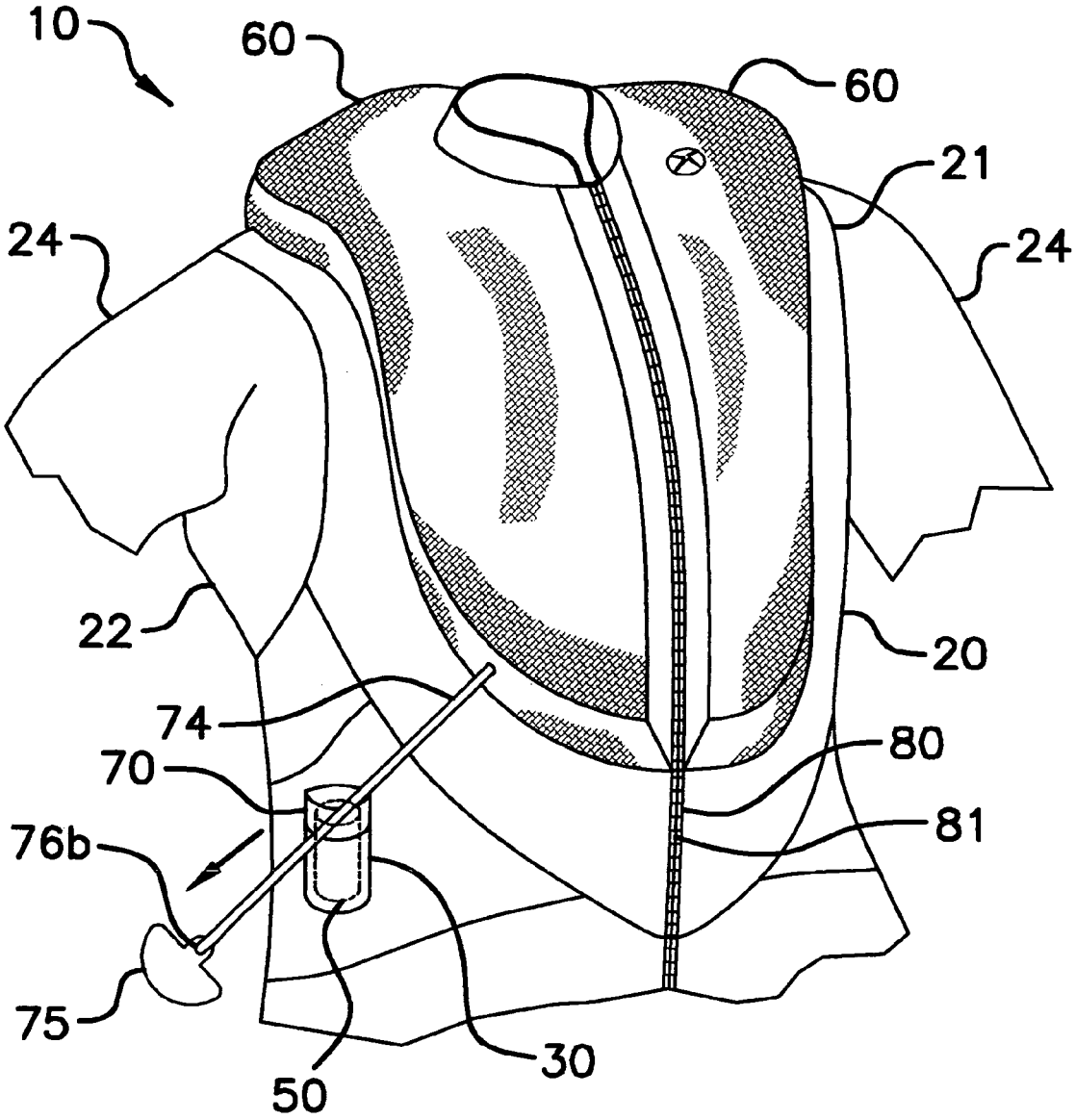
FIG. 2 is an enlarged perspective view showing the $CO_2$ canister and pull cord connected thereto.
Figure 3:
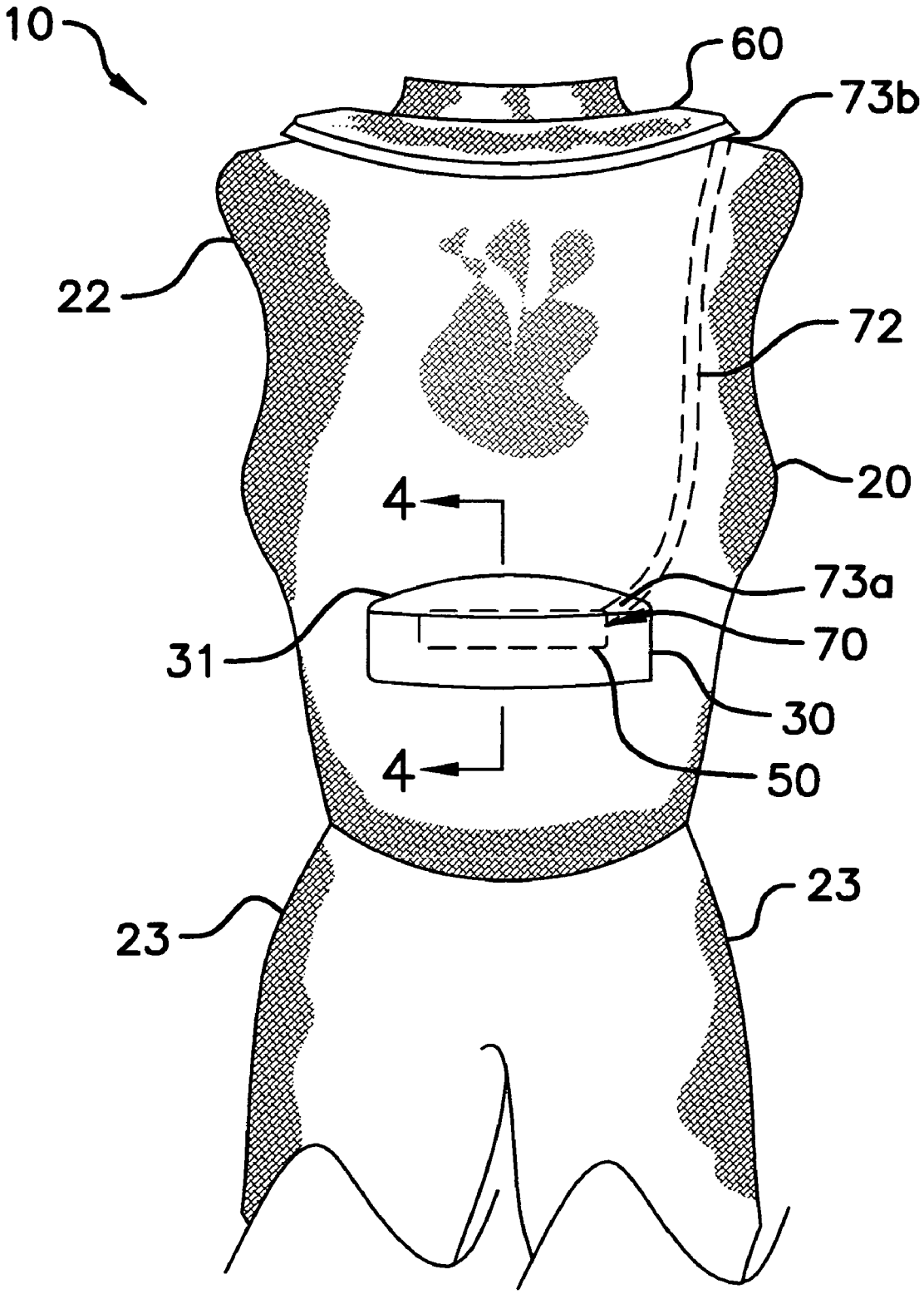
FIG. 3 is a rear elevational view of the pocket housing the canister at a horizontal position.
Figure 6:
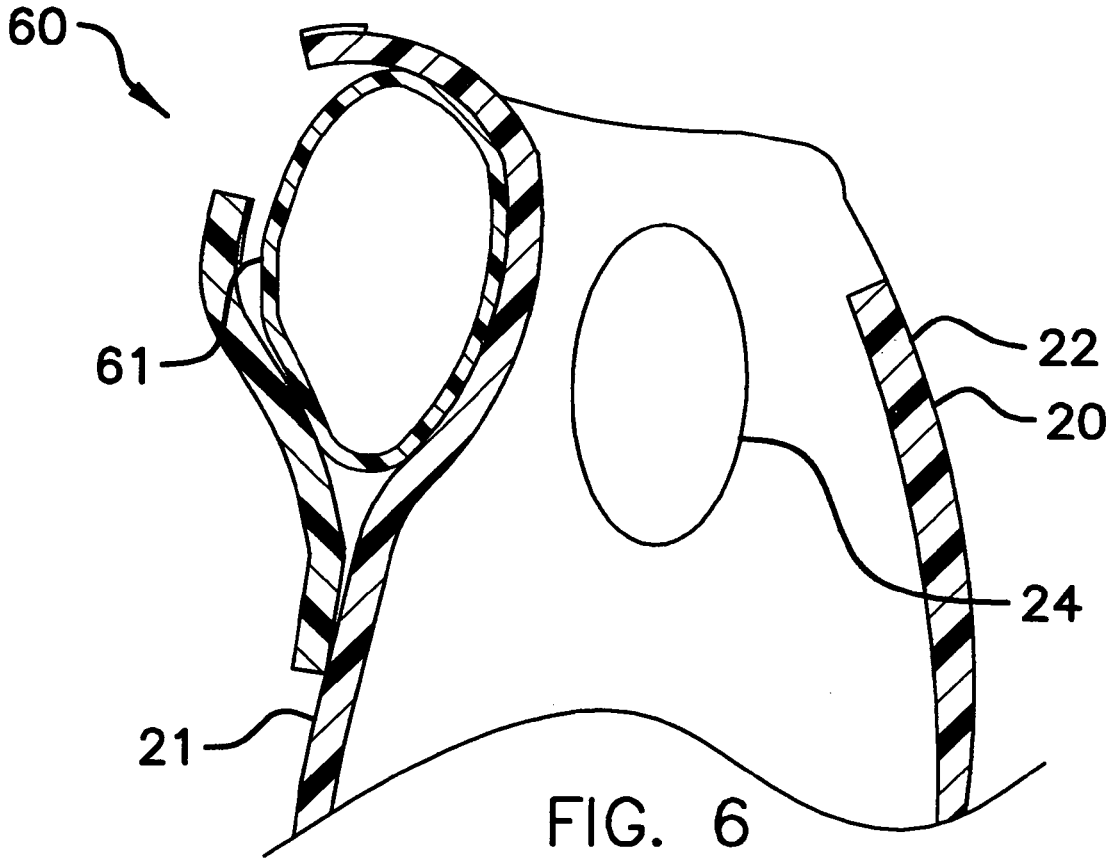
FIG. 6 is a cross-sectional view showing the bladder at an inflated position.

The inflating mechanism 70 also includes a flexible pull cord 74, as illustrated in FIGS. 1, 2 and 7, including a handle 75 for initiating the flow of $CO_2$. The pull cord 74 has opposed end portions 76*a*, b secured to the valve 71 and the handle 75 respectively. The handle 75 assists a user to selectively pull the cord 74 and open the valve 71 for advantageously inflating the bladder 60 wherein the bladder 60 is caused to expand, as shown in FIG. 6, as $CO_2$ flows out of the canister 50 and into the bladder 60. Thus, when a surfer or other individual wearing a wet suit, find themselves in a situation where floating by their own means is no longer possible a simple pull on the handle 75 can save their life.

The present invention also includes a mechanism 80 for conveniently adapting the wet suit 10 between open and closed positions. Such an adapting mechanism 80, including a zipper 81, is secured along the torso section 20. Of course, other conventional fasteners such as Velcro, for example, may be employed without departing from the true scope of the present invention.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A combination wet suit and personal flotation device for maintaining a user's head above a water line, said device comprising:

a wet suit being adaptable for conforming to a user's body, said wet suit including a torso section having front and rear portions, said rear portion including a pocket having a flap movable between open and closed positions for maintaining a water-proof seal, said pocket including a flexible retaining strap having opposed end portions secured to said wet suit within said pocket and removably fastened to said wet suit inside said pocket respectively, said strap for securing objects thereto and assisting to maintain the objects in a substantially stable and dry position, said wet suit further having a pair of leg and arm portions integral with said torso section and extending outwardly therefrom;

an inflatable bladder integral with said front portion of said torso section and positioned generally medially thereof subjacent the user's head, said bladder defining a cavity therein;

means for inflating said bladder; and means for adapting said wet suit between open and closed positions, said adapting means being secured along said torso section.

2. The device of claim 1, wherein said wet suit is formed from flexible neoprene material for maintaining a user's body temperature at a safe level.

3. The device of claim 1, wherein said inflating means comprises:

a $CO_2$ canister disposed within said pocket and for dispensing $CO_2$ during operating conditions wherein said strap extends about a partial circumference thereof for maintaining said canister at a substantially stable position;

a valve for regulating the flow of $CO_2$ into said bladder;

a tube having a horizontally disposed longitudinal axis and opposed end portions for defining a pathway through which $CO_2$ is directed, one said end portion being connected to said canister and another said end portion being connected to said valve; and a flexible pull cord including a handle for initiating the flow of $CO_2$, said pull cord having opposed end portions secured to said valve and said handle respectively, said handle for assisting a user to selectively pull said cord and open said valve for inflating said bladder wherein said bladder is caused to expand as $CO_2$ flows out of said canister and into said bladder.

4. The wet suit of claim 1, wherein said adapting means comprises a zipper.

5. The wet suit of claim 3, further comprising: a water proof clip having removably engageable first and second portions attached to said flap and said pocket respectively, said first portion being disengaged from said second portion when said second portion is pushed forwardly away from said flap portion so that a user can access said pocket and replace said $CO_2$ canister during periodic intervals.

6. A combination wet suit and personal flotation device for maintaining a user's head above a water line, said device comprising:

a wet suit being adaptable for conforming to a user's body and being formed from flexible neoprene material for maintaining a user's body temperature at a safe level, said wet suit including a torso section having front and rear portions, said rear portion including a pocket having a flap movable between open and closed positions for maintaining a water-proof seal, said pocket including a flexible retaining strap having opposed end portions secured to said wet suit within said pocket and removably fastened to said wet suit inside said pocket respectively, said strap for securing objects thereto and assisting to maintain the objects in a substantially stable and dry position, said wet suit further having a pair of leg and arm portions integral with said torso section and extending outwardly therefrom;

an inflatable bladder integral with said front portion of said torso section and positioned generally medially thereof subjacent the user's head, said bladder defining a cavity therein;

means for inflating said bladder; and means for adapting said wet suit between open and closed positions, said adapting means being secured along said torso section.

7. The device of claim 6, wherein said inflating means comprises:

a $CO_2$ canister disposed within said pocket for dispensing $CO_2$ during operating conditions wherein said strap extends about a partial circumference thereof for maintaining said canister at a substantially stable position;

a valve for regulating the flow of $CO_2$ into said bladder;

a tube having a horizontally disposed longitudinal axis and opposed end portions for defining a pathway through which $CO_2$ is directed, one said end portion being connected to said canister and another said end portion being connected to said valve; and a flexible pull cord including a handle for initiating the flow of $CO_2$, said pull cord having opposed end portions secured to said valve and said handle respectively, said handle for assisting a user to selectively pull said cord and open said valve for inflating said bladder wherein said bladder is caused to expand as $CO_2$ flows out of said canister and into said bladder.

8. The wet suit of claim 6, wherein said adapting means comprises a zipper.

9. The wet suit of claim 7, further comprising: a water proof clip having removably engageable first and second portions attached to said flap and said pocket respectively, said first portion being disengaged from said second portion when said second portion is pushed forwardly away from said flap portion so that a user can access said pocket and replace said $CO_2$ canister during periodic intervals.

10. A combination wet suit and personal flotation device for maintaining a user's head above a water line, said device comprising:

a wet suit being adaptable for conforming to a user's body and being formed from flexible neoprene material for maintaining a user's body temperature at a safe level, said wet suit including a torso section having front and rear portions, said rear portion including a pocket having a flap movable between open and closed positions for maintaining a water-proof seal, said pocket including a flexible retaining strap having opposed end portions secured to said wet suit within said pocket and removably fastened to said wet suit inside said pocket respectively, said strap for securing objects thereto and assisting to maintain the objects in a substantially stable and dry position, said wet suit further having a pair of leg and arm portions integral with said torso section and extending outwardly therefrom;

an inflatable bladder integral with said front portion of said torso section and positioned generally medially thereof subjacent the user's head, said bladder defining a cavity therein;

means for inflating said bladder and comprising a $CO_2$ canister for dispensing $CO_2$ during operating conditions, said canister being disposed within said pocket, said strap extending about a partial circumference thereof for maintaining said canister in a substantially stable position, a valve for regulating the flow of $CO_2$ into said bladder, a tube having a horizontally disposed longitudinal axis and opposed end portions for defining a pathway through which $CO_2$ is directed, one said end portion being connected to said canister and another said end portion being connected to said valve, and a flexible pull cord including a handle and for initiating the flow of $CO_2$, said pull cord having opposed end portions secured to said valve and said handle respectively, said handle for assisting a user to selectively pull said cord and open said valve for inflating said bladder wherein said bladder is caused to expand as $CO_2$ flows out of said canister and into said bladder; and means for adapting said wet suit between open and closed positions, said adapting means being secured along said torso section.

11. The wet suit of claim 10, wherein said adapting means comprises a zipper.

12. The wet suit of claim 10, further comprising: a water proof clip having removably engageable first and second portions attached to said flap and said pocket respectively, said first portion being disengaged from said second portion when said second portion is pushed forwardly away from said flap portion so that a user can access said pocket and replace said $CO_2$ canister during periodic intervals.

* * * * *